US006811249B2

(12) United States Patent
DeVries et al.

(10) Patent No.: US 6,811,249 B2
(45) Date of Patent: Nov. 2, 2004

(54) METHOD AND APPARATUS FOR DETERMINING A MINIMUM PRESSURE TO PRINT

(75) Inventors: Mark A. DeVries, Albany, OR (US); Rhonda L. Wilson, Monmouth, OR (US); Jeffrey L. Thielman, Corvallis, OR (US); Macia Sole, Sant Cugat del Valles Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/283,812

(22) Filed: Oct. 30, 2002

(65) Prior Publication Data

US 2004/0085412 A1 May 6, 2004

(51) Int. Cl.[7] ..... B41J 2/175
(52) U.S. Cl. ..... 347/85
(58) Field of Search ..... 347/5, 7, 85, 86, 347/87

(56) References Cited

U.S. PATENT DOCUMENTS 6,213,590 B1 4/2001 Fujii et al.
6,264,319 B1 7/2001 Altfather et al.
6,290,343 B1 9/2001 Lewis et al.
6,293,666 B1 9/2001 Mou et al.
6,454,375 B2 9/2002 Wilson et al.
2002/0047881 A1 4/2002 Lewis et al.

FOREIGN PATENT DOCUMENTS

EP 0840098 A2 5/1998
EP 1203666 A1 5/2002

*Primary Examiner*—Anh T. N. Vo

(57) ABSTRACT

A printer consumable includes an ink bag, and a supply of ink included within the ink bag, and optionally a memory device and a pressure sensor. The pressure sensor communicates an ink bag pressure loss measurement through a communication means to an ink delivery system. The communication means uses the ink bag pressure loss measurement to determine a minimum pressure to print. In one embodiment, the communication means periodically polls the pressure sensor to acquire the ink bag pressure loss measurement and records the measurement on the memory device of the printer consumable. When the communication means receives a print job, the measurement is acquired from the memory device to determine the minimum pressure to print before the print job is processed.

26 Claims, 5 Drawing Sheets

METHOD AND APPARATUS FOR DETERMINING A MINIMUM PRESSURE TO PRINT

FIELD OF THE INVENTION

The present invention relates to printing technology, and in particular to a method and means for determining a minimum pressure to print for ink delivery systems.

BACKGROUND OF THE INVENTION

In a common form of inkjet printers, an ink delivery system receives ink that is then ejected in order to produce an image on print media (e.g., paper, envelope, business card, slide, and the like). The ink is supplied from a printer consumable (e.g., an ink cartridge). In order for the printer consumable to supply the ink to the ink delivery system, the printer consumable is pressurized to an appropriate level to force the supply of ink out of the printer consumable.

As the printer consumable depletes its supply of ink, the amount of pressure needed to force the supply of ink out of the printer consumable increases. Conversely, when the supply of ink is nearly full within the printer consumable, the amount of pressure needed to force the supply of ink out of the printer consumable is less. During the period of time that the ink delivery system is properly pressurizing the printer consumable (e.g. print startup latency), any pending print job is delayed until the proper pressure is achieved within the printer consumable.

Conventional approaches unduly increase the startup latency associated with many print jobs processed during the life cycle of a supply of ink included within a printer consumable. This occurs because conventional approaches assume a worst-case pressure scenario in which the printer consumable is assumed to have nearly depleted its ink supply. By doing this, many print jobs are unnecessarily delayed by a period of time before starting, while an ink delivery system over pressurizes an ink bag associated with the printer consumable. Thus, conventional approaches unduly and unnecessarily delay the startup of print jobs when the printer consumable is nearly full of its ink supply. Furthermore, by assuming a worst-case scenario for all print jobs a pump associated with the ink delivery system is overworked, which can reduce the pump's useful life.

Therefore, there exists a need for a method and apparatus that determine a variable minimum pressure to print in an ink delivery system for a print job in order to accurately and variably delay the startup of print jobs by the real startup latency required by the ink delivery system in order to pressurize a printer consumable to an accurate level.

DETAILED DESCRIPTION OF THE INVENTION

The following description and the drawings illustrate specific embodiments of the invention sufficiently to enable those skilled in the art to practice it. Other embodiments may incorporate structural, logical, electrical, process, and other changes. Examples merely typify possible variations. Individual components and functions are optional unless explicitly required, and the sequence of operations may vary. Portions and features of some embodiments may be included in or substituted for those of others. The scope of the invention encompasses the full range of the claims and all available equivalents. The following description is, therefore, not to be taken in a limited sense, and the scope of the present invention is defined by the appended claims.

The functions described herein are implemented in software in one embodiment, where the software comprises computer executable instructions stored on computer readable media such as memory or other type of storage media (e.g., volatile, non-volatile, removable, fixed, and the like). The term "computer readable media" is also used to represent carrier waves on which the software is transmitted. Further, such functions correspond to modules, which are software, hardware, and firmware or any combination thereof. Multiple functions are performed in one or more modules as desired, and the embodiments described are merely examples.

Moreover, in various embodiments of the present invention, a printer consumable includes an ink or toner cartridge. Other printer consumables can include print media that is consumed in an ink delivery system and the like. The ink delivery system includes one or more printer consumables, devices for acquiring a supply of ink from one or more ink cartridges, devices for delivery of ink to a print media, and a controller or communication means that drives the processing of a print job through the ink delivery system.

The ink cartridge, in various embodiments of the present invention, includes a pressure sensor and an electronic chip. The pressure sensor dynamically measures the pressure loss in the ink cartridge during use. The electronic chip is operable, among other things, to house the pressure loss measurements obtained from the pressure sensor. In some embodiments, the electronic chip is a smart chip such as described in U.S. Pat. No. 5,835,817, REPLACEABLE PART WITH INTEGRAL MEMORY FOR USAGE, CALIBRATION, AND OTHER DATA. Of course the embodiments of the present invention are not intended to be so limited, as any electronic chip can be used to carry out the teachings of the present disclosure. Accordingly, all such electronic chips are intended to fall within the scope of the present disclosure.

Figure 1:
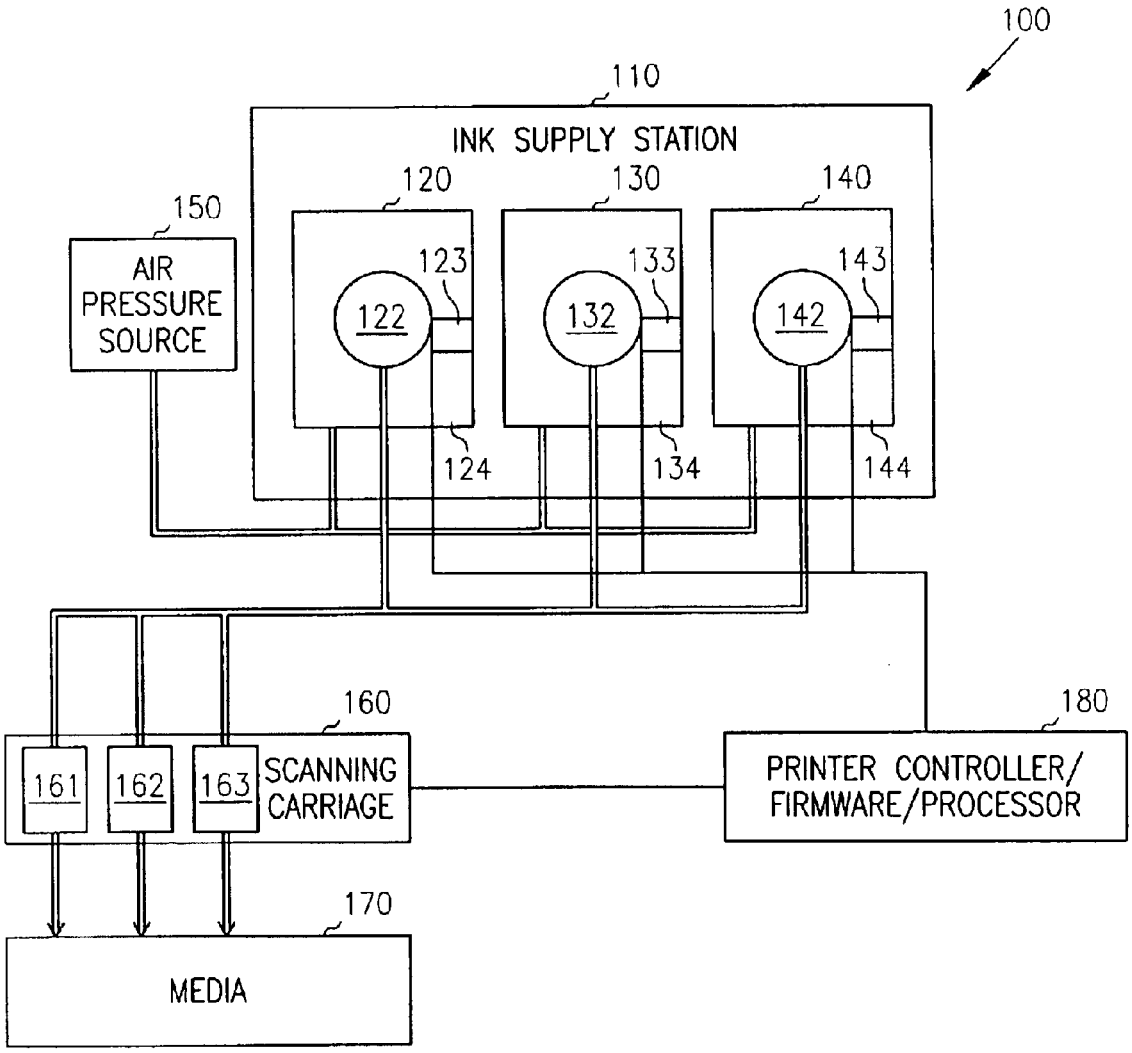
FIG. 1 is a block diagram of an ink delivery system, according to one embodiment of the present invention.

FIG. 1 is a block diagram of an ink delivery system 100, according to one embodiment of the present invention. As an overview, the ink delivery system 100 includes an ink supply station 110, a scanning carriage 160, print media 170, and a printer controller 180. The ink supply station 110 includes one or more printer consumables 121, 131, and 141. Printer consumables 120, 130, and 140 are ink cartridges having ink bags 122, 132, and 142, respectively. The ink bags 122, 132, and 142 include a supply of ink that is ejected out of the ink bags 122, 132, and 142 to supply ink to the ink delivery system 100 necessary for processing a print job to a print media 170.

The printer consumables 120, 130, and 140 also include a space of enclosed pressurized air 121, 131, and 141, respectively. The pressurized air combines with current pressures of the ink included in the ink bags 122, 132, and 142 to provide forces that are needed to eject the ink from the ink bags 122, 132, and 142 to the ink delivery system 100. Typically, the printer consumables 120, 130, and 140 are over pressurized with air during fabrication in order to account for losses in pressure when ink is depleted from the ink bags 122, 132, and 142, respectively. Thus, air increases as ink is depleted from the ink bags 122, 132, and 142.

In order for the scanning carriage 160 to deliver ink to the print media 170, the printheads 161, 162, and 163 must receive the ink with a minimum pressure that will permit the printheads 161, 162, and 163 to eject the ink onto the print media 170 at a proper rate and quality. Therefore, an air pressure source (e.g., air compressor, pump, and the like) 150 is provided with ink delivery system 100. The air pressure source 150 supplies an increase in pressure to the enclosed pressurized air spaces 121, 131, and 141, as directed by the printer controller (e.g., software, firmware, processor) 180.

While the ink delivery system 100 is properly pressurizing, any pending print job is stalled and will not start until the proper pressurization is acquired. This startup latency has been conventionally unduly extended because the minimum pressure to print is always assumed to be a worst-case scenario. Thus, even if only a minimum amount of pressure (e.g., ink supplies are nearly full) is needed to start a print job, then conventional systems will still over pressurize the pressurized air surrounding the ink bag to a fixed over pressurized level that is not needed. Often the fixed pressurization level is determined during the design and testing of conventional ink delivery systems and is based on the assumption that the printer consumables have nearly depleted ink supplies requiring significant pressure increases.

In various embodiments of the present invention, no fixed latency time to establish an increased pressurization level is needed. Accordingly, print jobs are processed within the ink delivery system 100 as soon as the ink delivery system 100 is properly pressurized to an accurate and variable level in order to process the print jobs. Thus, when the ink supplies are nearly full or not nearly empty, the startup latency for processing print jobs is reduced with the teachings of the present disclosure during much of the life cycle of the printer consumables 120, 130, and 140. This is achieved by acquiring bag pressure loss measurements from pressure sensors 123, 133, and 144 associated with the ink bags 122, 132, and 142, respectively.

The pressure sensors 123, 133, and 143 measure the pressure of the compressed air surrounding the spaces of pressurized air 121, 131, and 141, and the pressure of the ink supplies housed in the ink bags 122, 132, and 142. The measures, in one embodiment, are obtained after being polled by the printer controller 180 to obtain the measures. In another embodiment, the printer controller 180 records any polled measurement on electronic chips 124, 134, and 144 associated with the printer consumables 120, 130, and 140, respectively.

The printer controller 180 uses the recorded measurements associated with ink bag pressure losses to determine a minimum pressure to print when a print job is received for processing. In one embodiment, the minimum pressure to print is the maximum increased pressure needed to print and is selected from the printer consumable 120, 130, or 140 that has the least amount of ink supply and thus requires the most amount of increased pressurization.

The minimum pressure to print can also include any pressure needed to account for loss of pressure for the overall ink delivery system 100. This additional pressure can be derived through the fabrication, design, and testing of the ink delivery system 100 and is based on the amount of additional pressure needed by the ink delivery system 100 between print jobs to account for the movement of ink through various devices and components of the ink delivery system 100. The additional pressure can be configured in the printer controller 180 or provided as a parameter value to the printer controller 180, such that the printer controller 180 can determine or calculate an appropriate minimum pressure to print for each print job received after acquiring the ink bag pressure loss measurements from the printer consumables 120, 130, and 140, which is acquired in one embodiment from the electronic chips 124, 134, and 144, respectively. Moreover, the additional pressure used by the printer controller 180 can be the loss of pressure due to the viscous flow of ink within the ink delivery system 100 between print jobs.

In one embodiment, the printer consumables 120, 130, and 140 also include an initial pressure measurement that is associated with the initial pressure of the ink supplies when the printer consumables 120, 130, and 140 were manufactured and distributed for consumption. These initial pressure measurements are also stored/recorded on the electronic chips 124, 134, and 144, respectively. In this way, the printer controller 180 can use the initial pressure readings, any subsequent recorded ink bag pressure loss readings, and the overall configured system pressure loss to accurately determine and/or calculate the minimum pressure to print for each processed print job.

In an embodiment of the present invention where the printer consumables 120, 130, and 140 include an electronic chip 124, 134, and 144 that records and maintains ink bag pressure loss measurements, the printer consumables 120, 130, and 140 can carry the measurements to other ink delivery systems. Thus, when a consumer removes a printer consumable 120, 130, and/or 140 and reinstalls the consumable to another ink delivery system, a subsequent printer controller can obtain the measurement for determining a minimum pressure to print for the new ink delivery system.

In other embodiments, in order to reduce the expense associated with manufacturing the printer consumables 120, 130, and 140, the ink bag pressure loss measurements can be retained within an electronic chip of the ink delivery system 100, a memory of the ink delivery system 100, and/or in storage accessible to the ink delivery system 100. Further, in some embodiments, the pressure sensors 123, 133, and 143 can be implemented within the ink delivery system attached to various connections (e.g., tubes, needles, and the like) made between the printer consumables 120, 130, and 140 and the ink delivery system 100. This can further reduce the expense associated with manufacturing the printer consumables 120, 130, and 140. In fact, any configuration of an ink delivery system 100 that includes the pressure sensors 123, 133, and 143 and the capability to record ink bag pressure loss measurements is intended to fall within the scope of the present disclosure.

FIG. 1 is provided by way of illustration only and is not intended to limit various other embodiments of the present invention. It is readily apparent to one of ordinary skill in the art that not all components of the ink delivery system 100 are needed for the tenets of the present disclosure. For example, in some embodiments, the ink supply station 110 can be omitted, such as when only a single printer consumable is used within the ink delivery system. In addition, the ink delivery system 100 can include other components not listed in FIG. 1. For example, the ink delivery system can include interface ports, media bays, and/or input devices. Moreover, the ink delivery system 100 can be a standalone appliance (e.g., photo printer, printing kiosk, and the like) and/or an integrated peripheral to a computer system or network.

As one of ordinary skill in the art now appreciates, an embodiment of an ink delivery system 100 of the present invention reduces the time to start a print job when the supply of ink is not nearly empty. Moreover, with various embodiments of the present invention, printer consumables 120, 130, and 140 are portable to and integrated with other ink delivery systems. Further, in some embodiments, the printer consumables 120, 130, and 140 do not require over pressurization during manufacturing, since the ink delivery system 100 of the present invention accurately determines the needed increased in pressurization for each print job. By not over pressurizing printer consumables 120, 130, and 140, manufacturing defects can be minimized such as cartridge swell, ink leakages at fittings, and less work can be required of the ink delivery system's pumps, which can provide for a longer life of the pumps. Additionally, the ink delivery system 100 includes a variable pressurization level for each processed print job. This reduces time to print and reduces wear and tear on the ink delivery system's pumps.

Figure 2:
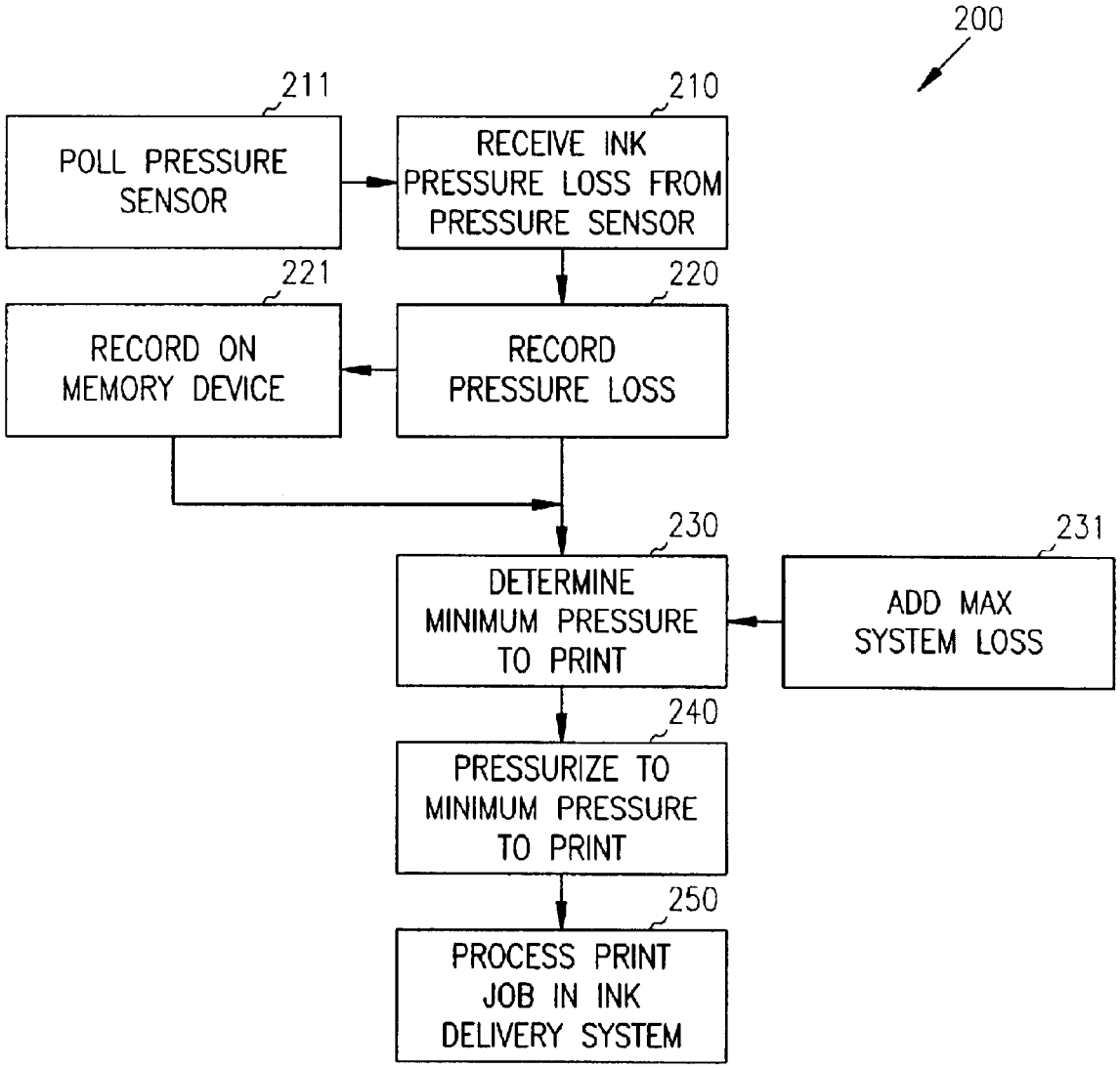
FIG. 2 is a flow chart illustrating a method to determine a minimum pressure to print, according to one embodiment of the present invention.

FIG. 2 is a flow chart illustrating one method 200 to determine a minimum pressure to print, according to one embodiment of the present invention. The method 200 is implemented within an ink delivery system. A printer controller (e.g., software and/or firmware), in one embodiment, processes the method 200 and drives the various devices and components of the ink delivery system to process a print job. In processing the print job, ink is acquired from one or more printer consumables (e.g., ink or toner cartridges), moved through the ink delivery system, and ejected onto a print media.

At 210, prior to processing a print job, the printer controller receives an ink bag pressure loss measurement associated with a printer consumable having a supply of ink. In one embodiment, this measurement is periodically requested by the printer controller polling a pressure sensor associated with the printer consumable, as depicted at 211. The pressure sensor can be part of the printer consumable or part of other components within the ink delivery system. The pressure loss measurement represents the difference in pressure between a space of air surrounding an ink bag of the printer consumable and the loss of pressure of the ink supply remaining in the ink bag.

At 220, the ink bag pressure loss measurement is recorded. In one embodiment, at 221, the ink bag pressure loss measurement is recorded/stored on an electronic chip of the printer consumable. In this way, when the printer controller needs to determine a minimum pressure to print for the ink delivery system, the most recent measurement is quickly and efficiently obtained from the electronic chip, and the printer controller need not delay in polling the pressure sensor in order to acquire the recent measurement. Moreover, since the measurement is recorded/stored on the electronic chip, the information is portable should the printer consumable be removed from one ink delivery system and installed in another ink delivery system.

In other embodiments, the ink bag pressure loss measurement is recorded within memory, and electronic chip, and/or storage of the ink delivery system. In this way, the manufacturing cost and/or design complexity of the printer consumables can be minimized.

Once the ink bag pressure loss measurement is obtained, then, at 230, the printer controller determines a minimum pressure to print based on the measurement when a print job is requested. The minimum pressure to print represents an amount of increased pressure needed within the space of enclosed air surrounding the ink bag of the printer consumable and an amount of increased pressure needed by the ink delivery system's various devices and components to process a supply of ink through the ink delivery system. Thus, in one embodiment, at 231, the minimum pressure to print is augmented by adding the ink bag pressure loss measurement to a system pressure representing the maximum amount of ink delivery system pressure loss that occurs between print jobs being processed within the ink delivery system. In one embodiment, the system pressure loss amount is configured within the printer controller based on a predetermined value that can be supplied to the printer controller as a parameter. The predetermined value can be determined during the design and testing of the ink delivery system.

The minimum pressure to print can also account for the elevation change of the printer consumable within the ink delivery system relative to the outlet that ejects a portion of the supply of ink from the printer consumable. For example, if the elevation of the outlet can result in an elevation pressure loss that is determined by the sum of the density of the ink multiplied by the difference in height of the outlet and further multiplied by the acceleration of gravity. The elevation of the outlet can be recorded within the ink delivery system, such that in embodiments where the printer consumable retains its ink pressure loss measurement and the printer consumable is installed in a different ink delivery system. The different ink delivery system can use its own elevation information for the printer consumable's outlet in order to accurately determine the minimal pressure to print.

At 240, the printer controller has determined the minimum pressure to print and then instructs the various devices of the ink delivery system to pressurize the enclosed space of air surrounding the ink bag to the appropriate level and to pressurize the various devices and components of the ink delivery system to their appropriate levels. The printer consumable is pressurized so an outlet of the printer consumable can eject a supply of the ink housed in the ink bag to the ink delivery system. Once this is completed, then, at 250, any pending or requested print job is processed through the ink delivery system to the appropriate print media.

Figure 3:
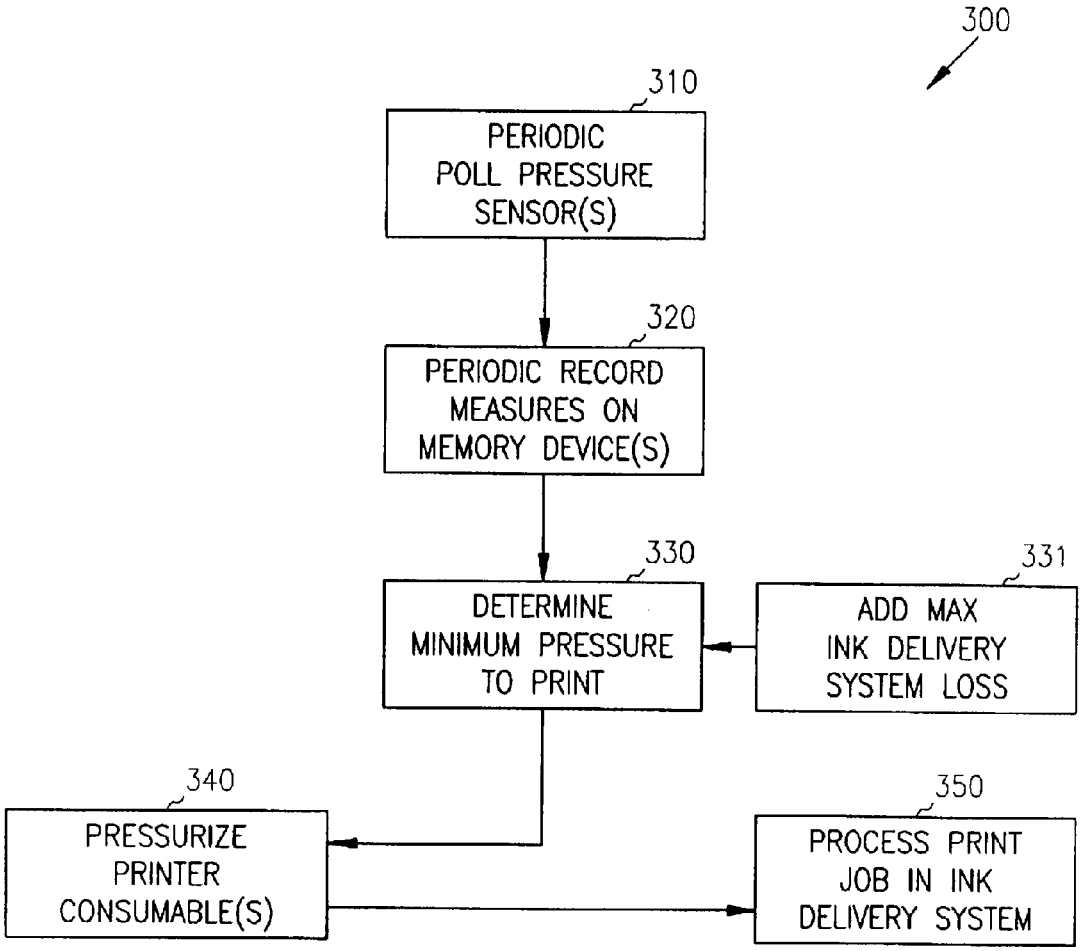
FIG. 3 is a flow chart illustrating another method to determine a minimum pressure to print, according to one embodiment of the present invention.

FIG. 3 illustrates a flow chart illustrating another method 300 to determine a minimum pressure to print, according to one embodiment of the present invention. Method 300 is implemented within the processing of a printer controller (e.g., software and/or firmware) that is in communication with one or more printer consumables (e.g., ink or toner cartridges) and an ink delivery system. The printer consumables supplies ink that is moved through the ink delivery system and deposited or ejected onto a print media.

At 310, the printer controller periodically polls one or more pressure sensors associated with the printer consumables. The polling results in a measurement for ink bag pressure loss representing the loss of pressure in an enclosed space of compressed air surrounding an ink bag of a printer consumable. Moreover, the measurement represents the pressure drop for the ink contained within the ink bag. The pressure drop between the enclosed space surrounding the ink bag and the pressure for the ink contained in the ink bag will be used to determine what increased amount of pressure must be directed by the printer controller in order to cause an air compressor to supply an appropriate amount of increased air to the enclosed space. This increased air pressure permits the printer consumable to eject a portion of its supply of ink into various needles and/or tubing components of the ink delivery system.

At 320, the printer controller periodically records/stores the acquired ink bag pressure loss measurements on electronic chips associated with each of the printer consumables. In other embodiments, the measurements are stored on computer readable media external to the printer consumables for later retrieval and use by the printer controller. In these other embodiments, the computer readable media can be volatile or non-volatile storage/memory and/or removable media.

When the printer controller detects a print job request, then the previous recorded measurements are obtained from the electronic chips of the printer consumables and/or from other computer readable media, as the case may be. In order to determine when to start the print job for processing, the ink delivery system determines a minimum pressure to print at 330. In one embodiment, where the ink delivery system includes a plurality of printer consumables, the printer controller determines a maximum amount of increased pressure needed for one of the printer consumables having the highest ink bag pressure loss measurement (e.g., the printer consumable with the least amount of available ink supply). If the ink delivery system includes only a single printer consumable, then the sole ink bag pressure loss measurement is used. In one embodiment, at 331, the minimum pressure to print is also augmented by adding a maximum amount of pressure needed by various components and devices within the ink delivery system to move ink through the system to a print media in order to satisfy the print job request. This system pressure measurement can be predetermined and supplied as a parameter to the printer controller when the printer controller is initialized within the ink delivery system.

At 340, the printer controller after having determined the minimum pressure to print for the print job request instructs the various devices and components of the ink delivery system to pressurize to the appropriate levels. The printer controller also instructs an air compressor or source device to pressurize the printer consumables to their appropriate pressure levels. After pressurization is complete, then, at 350, the printer controller processes the print job through the ink delivery system onto the appropriate print media.

In some embodiments, the printer consumables also include an initial pressurization level reading that is recorded on their respective electronic chips. Thus, the printer controller can use this initial reading in combination with a current recorded ink bag pressure loss measurement in order to determine what increased amount of pressure is needed for each print job as the ink supply is depleted. In other embodiments, the needed printer consumable pressurization level is predetermined and known to the printer controller without acquiring an initial value from the electronic chips, based on the type of printer consumable.

As one of ordinary skill in the art now appreciates, when a dynamically determined minimum pressure to print is low (indicating ink supply levels are not nearly empty), then a latency time associated with starting a requested print job is reduced. Accordingly, with the teachings of the various embodiments of the present invention the time to print is reduced for a portion of the printer consumables' life cycles. Conversely, with convention techniques the time to print is often unduly excessive for much of the printer consumables' life cycles, since conventional approaches do not variably determine a minimal pressure to print, which results in over pressurizing the printer consumables too frequently.

As is now readily apparent from the above descriptions, an ink delivery system implementing method 300 can reduce the startup latency for print jobs when the printer consumable includes a supply of ink that is not nearly empty. That is, the teachings of method 300 permit an ink delivery system to accurately determine a minimum pressure to print when a print job is received. The determination of the minimum pressure to print is dynamically determined and various based on the current supply of ink available in the printer consumable. Thus, a print job will start sooner when ink supplies are not nearly empty. Conversely, conventional techniques over pressurize all print jobs based on the assumption that the available ink supply in the printer consumable is nearly empty. In many circumstances, during the life of the printer consumable this conventional assumption is incorrect, and thus many print jobs are unduly and unnecessarily delayed. Conventional assumptions also unduly strain the pumps of the ink delivery system by over pressurizing the printer consumables too often when such over pressurization is not necessary.

Furthermore, in various embodiments of method 300, the current ink bag pressure loss measurement is carried with the printer consumable on an electronic memory device or "smart chip"; therefore, the printer consumables of the present disclosure can portably transfer the measurement to other ink delivery systems for use.

Figure 4:
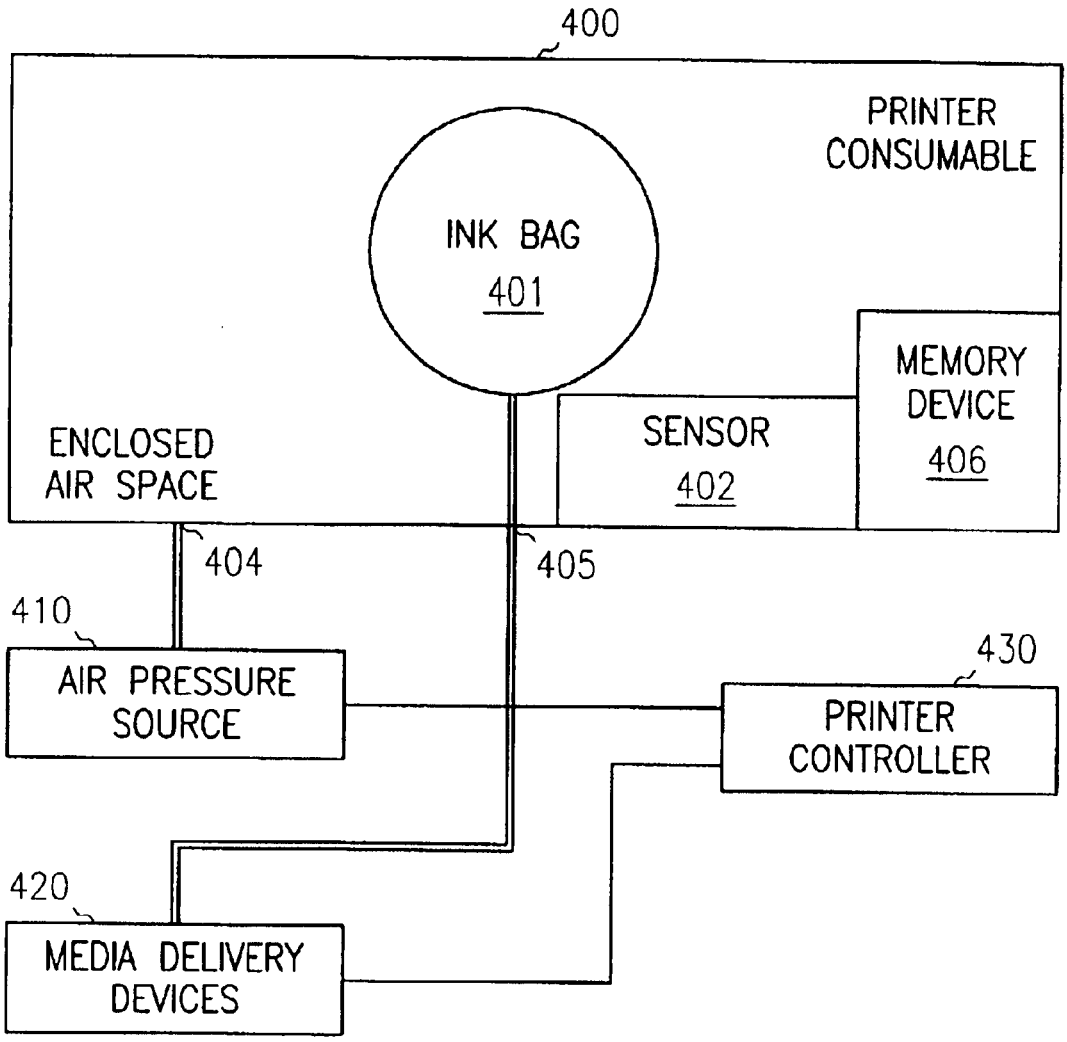
FIG. 4 is a block diagram of a printer consumable, according to one embodiment of the present invention.

FIG. 4 is a block diagram of one printer consumable 400, according to one embodiment of the present invention. The printer consumable 400 includes an ink bag 401, a pressure sensor 402, an enclosed air space 403, an inlet 404, an outlet 405, and an electronic chip 406. The ink bag 401 includes a supply of ink (not depicted in FIG. 4). The inlet 404 receives air from an air pressure source (e.g., air compressor and the like) of an ink delivery system. The outlet 405 supplies ink from the ink bag 401 based on the pressure of the enclosed air space 403 and the ink in the ink bag 401. The ink is delivered to various media delivery devices and components 420 of an ink delivery system utilizing the printer consumable 400 to process a print job.

The pressure sensor 402 measures an ink bag pressure drop associated with a loss of a portion of ink from the ink supply housed in the ink bag 401 and a loss of pressure in the enclosed air space 403. A printer controller 430 acquires the ink bag pressure loss measurement from the pressure sensor 402. In one embodiment, the printer controller 430 polls the pressure sensor 402 for the measurement. Polling can occur at fixed intervals and/or event driven periods. Once a measurement is obtained, the measurement is recorded/stored on the electronic chip 406. Thus, when the printer controller 430 needs to determine a minimum pressure to print, the measurement is quickly and efficiently acquired from the electronic chip 406 and there is no processing delay associated with the pressure sensor 402 providing the measurement.

Accordingly, when the printer controller 430 detects a print job request, the current ink bag pressure loss measurement is acquired from the electronic chip 406 of the printer consumable 400. The printer controller 430 then uses the ink bag pressure loss measurement to determine and/or calculate a minimum pressure to print for starting the print job request within the ink delivery system. The minimum pressure to print is a minimum amount of increased pressure that is supplied at the inlet 404 from the air pressure source 410 as directed by the printer controller 480. In one embodiment, this minimum pressure to print includes an additional pressure representing the maximum system flow pressure loss that the media delivery devices and components 420 need to move ink through the ink delivery system. In some embodiments, the ink delivery system includes one or more additional printer consumables 400, such that when the printer controller 480 determines the minimum pressure to print, the minimum pressure to print is selected as the highest ink bag pressure loss measurement from the available printer consumables 400 included within the ink delivery system.

The printer consumable 400 permits print jobs to start processing with an ink delivery system sooner than what has been achieved conventionally. This is so, because the ink bag pressure loss measurement is available on the electronic chip 406 for rapid consumption and variable determination by a printer controller 430 of an ink delivery system. Therefore, when the supply of ink in the ink bag 401 is not nearly empty, the ink delivery system starts the print jobs sooner than existing techniques, because existing techniques assume a worst-case scenario where the ink bag is mostly depleted of ink for all print jobs, and thereby too frequently over pressurize the printer consumables. Thus, by dynamically and accurately determining the minimum pressure to print with the teachings of the present disclosure time to print can be reduced for a large portion of a printer consumable's life cycle. Further, the printer consumable 400 maintains the most recent ink bag pressure loss measurement on the electronic chip 406, so the printer consumable can be easily removed and reinstalled from one ink delivery system to another ink delivery system without losing the benefits of the measurement.

Figure 5:
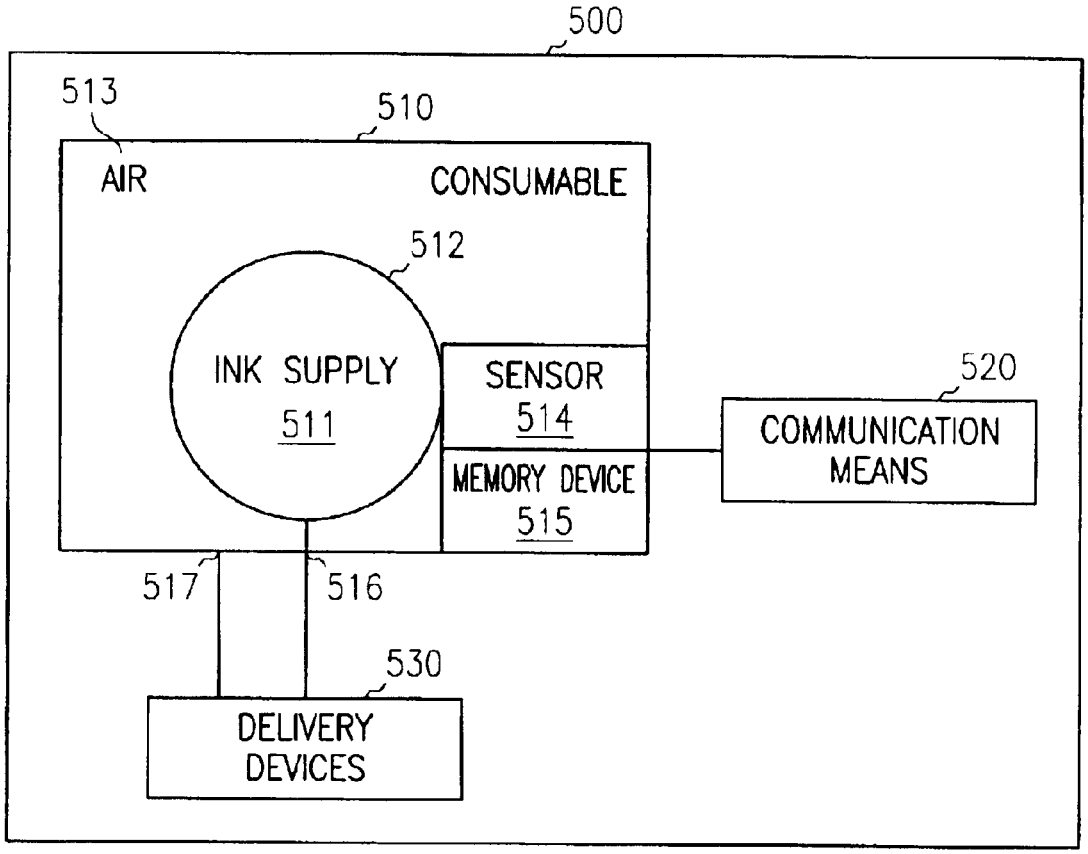
FIG. 5 is a block diagram of another ink delivery system, according to one embodiment of the present invention.

FIG. 5 is a block diagram of another ink delivery system 500, according to one embodiment of the present invention. The ink delivery system 500 includes a printer consumable 510, a communication means 520, and one or more ink delivery devices and/or components 530. The printer consumable 510 includes an ink bag 512 having a supply of ink 511, where the supply of ink 511 depletes as ink is consumed by the ink delivery system 500. The printer consumable 510 also includes compressed air 513 that surrounds the ink bag 513, a pressure sensor, and an electronic chip 515.

The pressure sensor 514 measures the loss of ink bag pressure as determined by the pressure drop between the pressurized air 513 and the pressure in the ink supply 511. The ink bag pressure loss measurements are operable to be recorded/stored on the electronic chip 515. The communication means 520 interfaces with the sensor 514, the electronic chip 515, and the ink delivery devices and components 530.

In some embodiments, the pressure sensor 514 is not attached to the printer consumable 510, rather the pressure sensor 514 can be part of other components of the ink delivery system 500. Furthermore, the electronic chip 514, need not exist for all embodiments of the present invention, since the ink bag pressure loss measurements can be retained by storage and/or memory accessible to the ink delivery system 500 and external from the printer consumable 510.

In one embodiment, the communication means 520 is firmware embedded in processors of the ink delivery devices and components 530. In other embodiments, the communication means 520 is a set of executable instructions or software that processes on the ink delivery devices and components 530 and/or external to the ink delivery devices and components 530. In still other embodiments, the communication means 520 is combination of firmware and software interfaced to the printer consumable 510 and the ink delivery devices and components 530.

The communication means 520 periodically polls the sensor 514 to take an ink bag pressure loss measurement. The communication means 520 records/stores the measurement to the electronic chip 515, once it is acquired from the sensor 514. At some point in time, after a measurement has been recorded on the electronic chip 515, the communication means 520 detects a request to process a print job. The print job can be directly requested of the ink delivery system 500, such as when the ink delivery system 500 is a standalone appliance (e.g., photo printer, printer kiosk, and the like). Alternatively, the print job can be indirectly requested of the ink delivery system 500, such as when the ink delivery system 500 is used as a peripheral to a computer system and/or network.

Once the communication means 520 receives a print job request, the communication means 520 reads the electronic chip 515 to acquire the ink bag pressure loss measurement. This measurement is used by the communication means 520 to determine a minimum pressure to print for the printer consumable 510 and the ink delivery devices and components 530. This minimum pressure to print is an amount of increased air pressure that the communication means 520 instructs a number of the ink delivery devices and components 530 to deliver through an inlet 517 of the printer consumable 510. The inlet 517 can be used to directly inject air to the enclosed space of air 513 of the printer consumable 510, which increases the pressure with which ink is ejected out of an outlet 516 and into the ink delivery system 500.

In one embodiment, the minimum pressure to print is determined by adding a current ink bag pressure loss measurement to a total ink delivery system pressure loss value, where the value is predetermined and provided to the communication means 520. Moreover, the value represents an amount of pressure that is loss within the ink delivery system devices and components 530 between print jobs.

Once a minimum pressure to print is determined and the increased pressure is added, then the requested print job can be initiated within the ink delivery system 500. Furthermore, the startup latency is reduced when the minimum pressure to print is low, such as when the ink supply 511 is not nearly empty within the ink bag 512 of the printer consumable 510.

In one embodiment, the printer consumable 510 is manufactured such that the enclosed space of air 513 is not over pressurized to account for loses in pressure. This can decrease manufacturing defects associated with printer consumable container swell, ink loss at fittings within the ink delivery system 500, and lessen the workload of pumps associated with the ink delivery system. In other embodiments, the printer consumable 500 is over pressurized to reduce the amount of pressure that must be added during a life cycle of the printer consumable 500.

As is now apparent to one of ordinary skill in the art, print jobs can achieve reduced startup latency within ink delivery systems 500 during much of a life cycle of a printer consumable 510 with the teachings of the present disclosure. Furthermore, in some embodiments, printer consumables 510 can portably retain and provide pressure loss measurements through the use of electronic chip 515 to one or more ink delivery systems 500. The printer consumables 510 can also provide current ink bag pressure loss measurements through their corresponding pressure sensors 514.

Although specific embodiments have been illustrated and described herein, those of ordinary skill in the art will appreciate that any arrangement calculated to achieve the same purpose can be substituted for the specific embodiments shown. This disclosure is intended to cover any and all adaptations or variations of various embodiments of the invention. It is to be understood that the above description has been made in an illustrative fashion, and not a restrictive one. Combinations of the above embodiments, and other embodiments not specifically described herein will be apparent to one of ordinary skill in the art upon reviewing the above description. The scope of various embodiments of the invention includes any other applications in which the above structures and methods are used. Therefore, the scope of various embodiments of the invention should be determined with reference to the appended claims, along with the full range of equivalents to which such claims are entitled.

It is emphasized that the Abstract is provided to comply with 37 C.F.R. §1.72(b) requiring an Abstract that will allow the reader to quickly ascertain the nature and gist of the technical disclosure. It is submitted with the understanding that it will not be used to interpret or limit the scope or meaning of the claims.

In the foregoing Detailed Description, various features are grouped together in a single embodiment for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate preferred embodiment.

What is claimed is:

1. A method for determining a minimum pressure to print a print job, comprising:

receiving a measurement of ink bag pressure loss from a pressure sensor, wherein the pressure sensor is integrated with the ink bag; and dynamically determining a minimum pressure to print based on the measurement.

2. The method of claim 1 further comprising, pressurizing an enclosed space around an ink bag to the minimum pressure to print before processing the print job.

3. The method of claim 1 further comprising, recording the measurement in a computer readable medium accessible to a printer controller of a printer.

4. The method of claim 3 wherein in recording, the computer readable medium is an electronic chip.

5. The method of claim 3 wherein in recording, the measurement is received and recorded prior to determining the minimum pressure to print.

6. The method of claim 1 wherein in dynamically determining, the minimum pressure to print represents an amount of increased pressure that is needed at an outlet of a printer consumable for delivering ink from an ink bag to an ink delivery system.

7. The method of claim 1 wherein in determining, the minimum pressure to print equals a maximum system ink flow loss plus the measurement.

8. A method for determining a minimum pressure to print a print job, comprising:

receiving a measurement of ink bag pressure loss from a pressure sensor; and dynamically determining a minimum pressure to print based on the measurement, wherein a printer controller periodically polls a pressure sensor associated with an ink bag in order to receive the measurement, and the measurement is recorded on a memory device associated with a printer consumable housing the ink bag, and wherein the measurement is acquired by the printer controller from the memory device in order to determine the minimum pressure to print when a request for the print job is received by the printer controller.

9. A method of determining a minimum pressure to print, comprising;

periodically polling one or more pressure sensors that provide ink bag pressure loss measurements for printer consumables in an ink delivery system;

periodically recording the measurements on one or more memory devices associated with the printer consumables; and determining a minimum pressure to print for a print job based on the recorded measurements and a maximum ink delivery system flow pressure loss measurement.

10. The method of claim 9 further comprising, pressurizing one or more of the printer consumables by the minimum pressure to print.

11. The method of claim 9 further comprising, processing the print job after the one or more printer consumables are pressurized by the minimum pressure to print.

12. The method of claim 9 wherein in periodically polling, the polling is performed by a printer controller in communication with the ink delivery system.

13. The method of claim 12 wherein in determining, the maximum ink delivery system flow pressure loss measurement is a predetermined value accessible to the printer controller and associated with the ink delivery system.

14. The method of claim 13 wherein in determining, when a pressure value associated with the minimum pressure to print is low a latency time associated with starting the print job is reduced.

15. The method of claim 9 wherein in periodically recording, the memory devices are electronic memory chips affixed to the printer consumables, and each chip includes an initial pressure representing an initial installed pressure associated with the printer consumables.

16. A printer consumable, comprising:

an ink bag having a supply of ink and pressurized air in an enclosed space surrounding the ink bag;

an inlet for receiving an increase in the pressurized air;

an outlet for supplying a portion of the supply of ink to an ink delivery system;

a pressure sensor for measuring an ink bag pressure loss associated with a loss of a portion in the supply of ink and a loss of a portion of the pressurized air, and wherein the pressure sensor is integrated with the ink bag; and wherein the ink bag pressure loss is operable to be acquired from the pressure sensor by a printer controller in communication with the ink delivery system, and the ink bag pressure loss is recorded on a memory device and used by the printer controller to determine a minimum pressure to pressurize the inlet of the printer consumable prior to requesting a portion of the supply of ink from the printer consumable.

17. The printer consumable of claim 16 wherein the minimum pressure to pressurize the inlet is equal to a maximum system flow pressure loss plus a maximum ink bag pressure loss identified as a maximum ink bag pressure loss selected from the ink bag pressure loss of the printer consumable and one or more additional ink bag pressure loss measurements from one or more additional printer consumables used in the ink delivery system.

18. The printer consumable of claim 16 wherein the printer consumable is an ink jet printer cartridge.

19. The printer consumable of claim 16 wherein the pressurized air is combined with a current portion of the supply of ink to create ink pressure that delivers the current portion of the supply of ink to the outlet for use by the ink delivery system.

20. A printer consumable, comprising:

an ink bag having a supply of ink and pressurized air in an enclosed space surrounding the ink bag;

an inlet for receiving an increase in the pressurized air;

an outlet for supplying a portion of the supply of ink to an ink delivery system;

a pressure sensor for measuring an ink bag pressure loss associated with a loss of a portion in the supply of ink and a loss of a portion of the pressurized air, and wherein the ink bag pressure loss is operable to be acquired from the pressure sensor by a printer controller in communication with the ink delivery system, and the ink bag pressure loss is recorded on a memory device and used by the printer controller to determine a minimum pressure to pressurize the inlet of the printer consumable, wherein the ink bag pressure loss is recorded before the printer controller determines the minimum pressure to pressurize the inlet.

21. An ink delivery system, comprising:

a printer consumable having a supply of ink, a pressure sensor, a memory device, and an ink bag housing the supply of ink, and wherein the pressure sensor is integrated with the ink bag;

communication means between the printer consumable and an ink delivery system; and wherein the communication means retrieves an ink bag pressure loss measurement from the electronic chip of the printer consumable prior to processing a print job and determines a minimum pressure to print before processing the print job in the ink delivery system, and wherein the communication means periodically polls the pressure sensor to acquire the ink bag pressure loss measurement that is recorded on the memory device of the printer consumable.

22. The ink delivery system of claim 21, wherein the minimum pressure to print is used to pressurize air surrounding the ink bag in order to deliver a portion of the supply of ink to the ink delivery system for printing.

23. The ink delivery system of claim 21, wherein when the minimum pressure to print is low, a startup latency time to print is reduced within the ink delivery system.

24. The ink delivery system of claim 21, wherein the printer consumable is removable from the ink delivery system and installable in a different ink delivery system.

25. The ink delivery system of claim 21, wherein the ink bag is not over pressurized before initial consumption of the supply of ink in the ink delivery system.

26. An ink delivery system, comprising:

a printer consumable having a supply of ink, a pressure sensor, a memory device, and an ink bag housing the supply of ink;

communication means between the printer consumable and an ink delivery system; and wherein the communication means retrieves an ink bag pressure loss measurement from the electronic chip of the printer consumable prior to processing a print job and determines a minimum pressure to print before processing the print job in the ink delivery system, and wherein the communication means periodically polls the pressure sensor to acquire the ink bag pressure loss measurement that is recorded on the memory device of the printer consumable, and wherein the memory device is read by a different communication means of the different ink delivery system in order to determine a new minimum pressure to print for the different ink delivery system.

* * * * *